US011040388B2

(12) United States Patent
Kataoka et al.

(10) Patent No.: US 11,040,388 B2
(45) Date of Patent: Jun. 22, 2021

(54) ROLL CUTTER DEVICE

(71) Applicant: Koto Engraving Co., Ltd., Tokyo (JP)

(72) Inventors: Kojiro Kataoka, Tokyo (JP); Hiroshi Misono, Tokyo (JP); Isamu Sakayori, Tokyo (JP)

(73) Assignee: KOTO ENGRAVING CO., LTD., Tokyo (JP)

( * ) Notice: Subject to any disclaimer, the term of this patent is extended or adjusted under 35 U.S.C. 154(b) by 0 days.

(21) Appl. No.: 16/344,364

(22) PCT Filed: Jul. 10, 2018

(86) PCT No.: PCT/JP2018/025984
§ 371 (c)(1),
(2) Date: Apr. 24, 2019

(87) PCT Pub. No.: WO2019/013188
PCT Pub. Date: Jan. 17, 2019

(65) Prior Publication Data

US 2019/0283103 A1 Sep. 19, 2019

(30) Foreign Application Priority Data

Jul. 14, 2017 (JP) ..... JP2017-138248

(51) Int. Cl.
*B21D 28/12* (2006.01)
*B26D 7/26* (2006.01)
(Continued)

(52) U.S. Cl.
CPC ..... *B21D 28/12* (2013.01); *B26D 7/2628* (2013.01); *B26F 1/38* (2013.01); *B26F 1/384* (2013.01); *B26F 1/44* (2013.01); *B26D 2210/11* (2013.01)

(58) Field of Classification Search
CPC .... B21D 28/12; B26D 7/2628; B26D 7/2635; B26D 7/26; B26D 2210/11; B26F 1/38; B26F 1/384; B26F 1/44
(Continued)

(56) References Cited

U.S. PATENT DOCUMENTS 2,698,661 A * 1/1955 MacQuarrie ..... B23D 19/06 83/446
3,831,502 A * 8/1974 Tokuno ..... B26D 1/00 493/353
(Continued)

FOREIGN PATENT DOCUMENTS

IT CR20090040 A1 3/2011
JP 53-2517 1/1978
(Continued)

OTHER PUBLICATIONS

International Search Report—PCT/JP2018/025984—dated Sep. 4, 2018.
(Continued)

*Primary Examiner* — Ghassem Alie
*Assistant Examiner* — Nhat Chieu Q Do
(74) *Attorney, Agent, or Firm* — Nixon & Vanderhye

(57) ABSTRACT

This roll cutter device is provided with roll units in which a thin plate material is passed between a pair of rolls. Three sets of the roll units are provided in an axial direction of the rolls in such a way that central axes of the rolls lie on one straight line in the axial direction. The configuration is such that a plurality of the roll units including an upper roll and a receiving roll exist in the axial direction.

5 Claims, 4 Drawing Sheets

(51) Int. Cl.
*B26F 1/38* (2006.01)
*B26F 1/44* (2006.01)

(58) Field of Classification Search
USPC ..... 83/331–349
See application file for complete search history.

(56) References Cited

U.S. PATENT DOCUMENTS

| | | | | |
|---|---|---|---|---|
| 4,180,978 | A | 1/1980 | Maddock | |
| 2018/0029244 | A1 * | 2/2018 | Yamamuro | B26D 1/40 |

FOREIGN PATENT DOCUMENTS

| | | | | |
|---|---|---|---|---|
| JP | 55-54757 | | 4/1980 | |
| JP | 2001-179695 | | 7/2001 | |
| JP | 2001-30888 | | 10/2001 | |
| JP | 2004-66431 | | 3/2004 | |
| JP | 2004-532739 | | 10/2004 | |
| JP | 2005-192985 | | 7/2005 | |
| JP | 2017-024073 | A | 2/2017 | |
| WO | 03/004191 | | 1/2003 | |
| WO | 2011/096361 | | 8/2011 | |
| WO | WO-2011096361 | A1 * | 8/2011 | B44B 5/0085 |

OTHER PUBLICATIONS

Extended European Search Report issued in European Patent Application No. 18832261.4 dated Feb. 26, 2021.

* cited by examiner

ROLL CUTTER DEVICE

TECHNICAL FIELD

This invention relates to a roll cutter device which pulls a blanked material out of a thin plate material or applies boring to a thin plate-shaped sheet.

BACKGROUND ART

A roll cutter device is known, for example, which performs processing, such as putting a notch of a required shape, in a sheet-shaped work printed with a label or the like (Patent Document 1, for example). Generally, the roll cutter device passes a sheet material or the like between a cutter roll formed with a cutting blade and a receiving roll, or between a pair of cutter roils each formed with a cutting blade, and drivingly rotates the cutter roll, etc., or corotates the cutter roll, etc. in accordance with the passage of the work between the rolls, thereby performing processing on the work continuously.

With the conventional roll cutter device, the width of the sheet-shaped work is determined by the axial length of the roll. By using long rolls, a wide work can be continuously processed. The use of the long rolls, however, makes it necessary to deal with deflection or the like, and requires upsizing of the device because of weight. The use of the long rolls, moreover, necessitates the replacement of the rolls, if the cutting blade or a part of a functional site is damaged, for example.

With the roll cutter device in current use, therefore, there are limits to the width of the work which can be processed without the use of an extensive device.

PRIOR ART DOCUMENTS

Patent Documents

Patent Document 1: JP-A-2004-66431

SUMMARY OF THE INVENTION

Problems to be Solved by the Invention

The present invention has been accomplished in the light of the foregoing circumstances. It is an object, of the invention to provide a roll cutter device which can process a wide thin plate material without using an extensive device.

Means for Solving the Problems

A roll cutter device of the present invention according to a first aspect, aimed at attaining the above object, is characterized in that it is equipped with a roll unit composed of a pair of rolls, at least one of the rolls being formed with a cutting blade, and an adjustment means for adjusting an interaxial distance of the pair of rolls, a thin plate material is passed between the pair of rolls, and a plurality of the roll units are provided in the axial direction of the rolls so that the central axes of the rolls are on straight lines in the axial direction.

With the present invention according to the first aspect, a plurality of the roll units each having a pair of rolls are present in the axial direction, so that the width of a thin plate material which can be processed can be increased without the need to make the rolls long. Moreover, the interaxial distance of the pair of rolls can be adjusted individually by the adjustment means. Thus, different types of processing can be performed in the width direction and, even in the event of damage or the like caused to any of the rolls, it can be dealt with by handling only the defective roll. Furthermore, weight reduction of the rolls can be realized by shortening one of the rolls. Even if the thickness of the thin plate material is small, therefore, the rolls can be corotated easily.

A combination of a cutter roll formed with a cutting blade and a receiving roll is applied as the pair of rolls, whereby the roll cutter device for performing blanking can be constituted. Alternatively, a pair of cutter rolls each formed with a cutting blade is applied as the pair of rolls, whereby the roll cutter device for boring fine holes can be constituted. A work with a thickness of the order of 0.005 mm to 0.1 mm can be used as the thin plate material.

It becomes possible, therefore, to perform processing on a thin plate material having a large width, without rendering the device extensive.

A roll cutter device of the present invention according to a second aspect is the roll cutter device according to the first aspect, characterized in that it is equipped with a second roll unit composed of a pair of second rolls, at least one of the second rolls being formed with a second cutting blade, and a second adjustment means for adjusting an interaxial distance of the pair of second rolls, the thin plate material is passed between the pair of second rolls, and the second roll unit is disposed on at least one of an upstream side and a downstream side of the roll units in the passing direction of the thin plate material and disposed at a position such that first roll units and the second roll units are in different widthwise regions that extend in the passing direction of the thin plate material.

Thus, the plurality of the first roll units and the second roll units can be arranged in different regions in the width direction of the thin plate material. That is, at least three of the roll units can be arranged, and the width of the thin plate material that can be processed can be rendered larger.

A roll cutter device of the present invention according to a third aspect is the roll cutter device according to the second aspect, wherein a plurality of the second roll units are provided in the axial direction of the second rolls so that the central axes of the second roils are on straight lines in the axial direction.

With the present invention according to the third aspect, the plurality of roll units and the plurality of second roll units can be arranged in the width direction of the thin plate material. Consequently, the width of the thin plate material that can be processed can be rendered even larger.

Effects of the Invention

The roll cutter device of the present invention makes it possible to perform processing on a thin plate material having a large width, without rendering the device extensive.

MODE FOR CARRYING OUT THE INVENTION

The roll cutter device of the present invention is equipped with a roll unit which is composed of a pair of rolls and an adjustment means for adjusting the interaxial distance of the pair of rolls, and which passes a thin plate material (sheet material) between the pair of rolls. Three of the roll units are provided in the axial direction of the rolls so that the central axes of the rolls are on a straight line in the axial direction.

A second roll unit is provided on the downstream side of the roll units in the passing direction of the sheet material. The second roll unit is composed of a pair of second rolls, and a second adjustment means for adjusting the interaxial distance of the pair of second rolls. Two of the second roll units are arranged at positions including a range where there are none of the roll units, namely, at positions including the spaces between the roll units, in the passing direction of the sheet material.

Hence, two sets of the two roll units each having the pair of rolls are present in the axial direction, and two of the second roll units each having the pair of second rolls are present in the axial direction at positions displaced from the positions of the roll units. That is, the roll units and the second roll units are arranged zigzag in the width direction of the sheet material. Consequently, the width of the thin plate material which can be processed can be rendered great without the need to make any one of the rolls long.

The roll cutter device of the present invention will be described concretely based on FIGS. 1 to 4.

Figure 1:
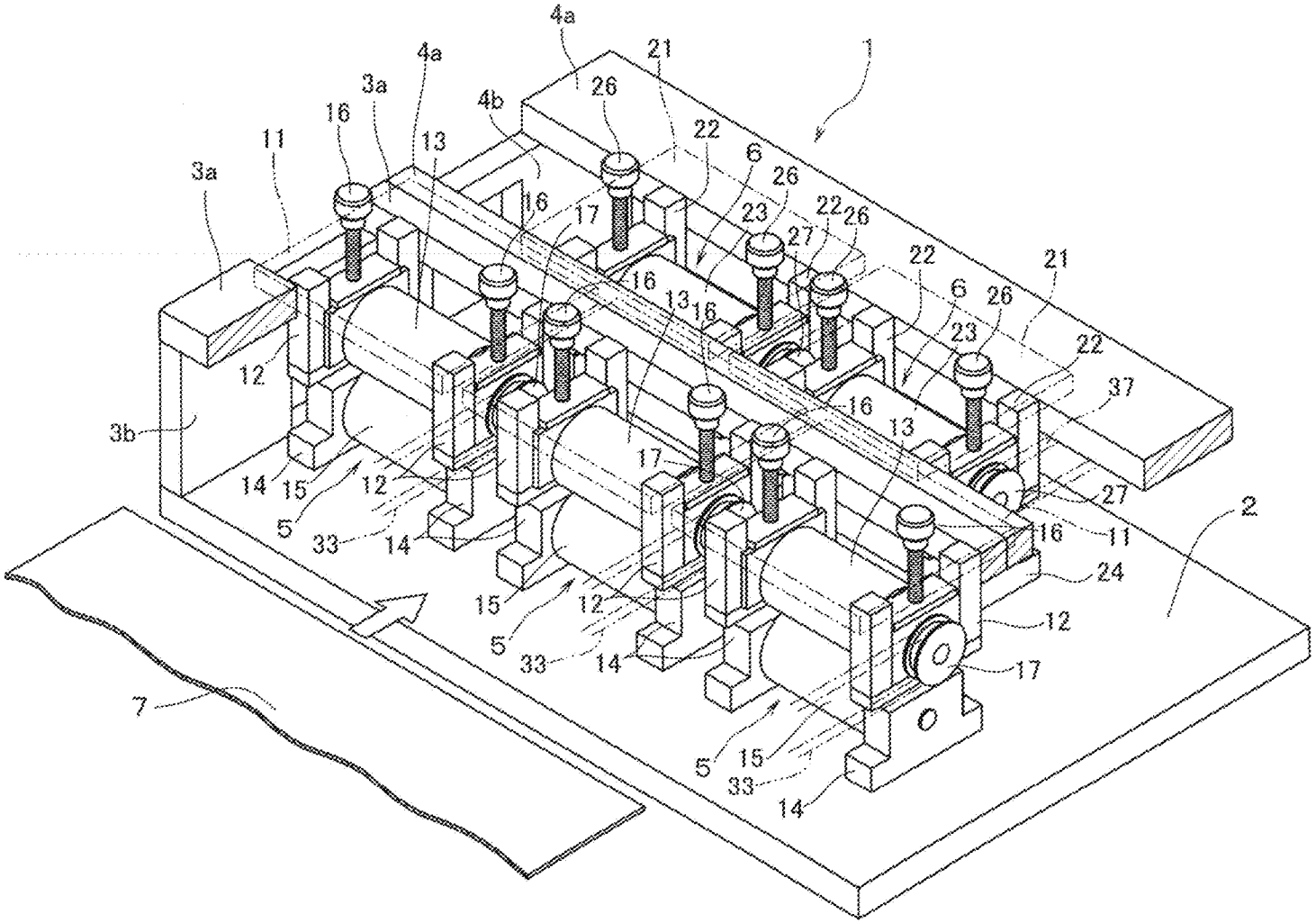
FIG. 1 is an external view of a roll cutter device according to an embodiment of the present invention.
Figure 2:
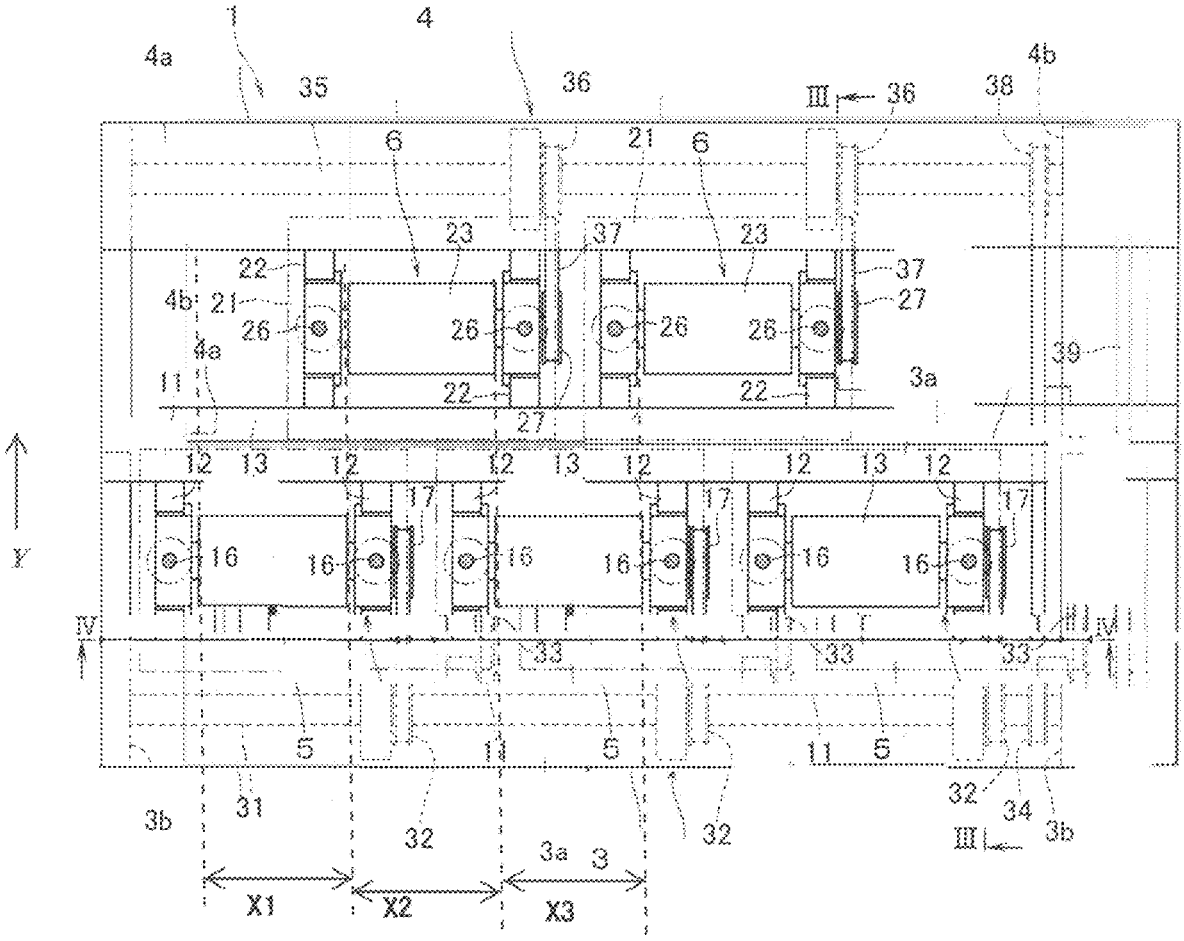
FIG. 2 is a plan view of the roll cutter device according to the embodiment of the present invention.
Figure 3:
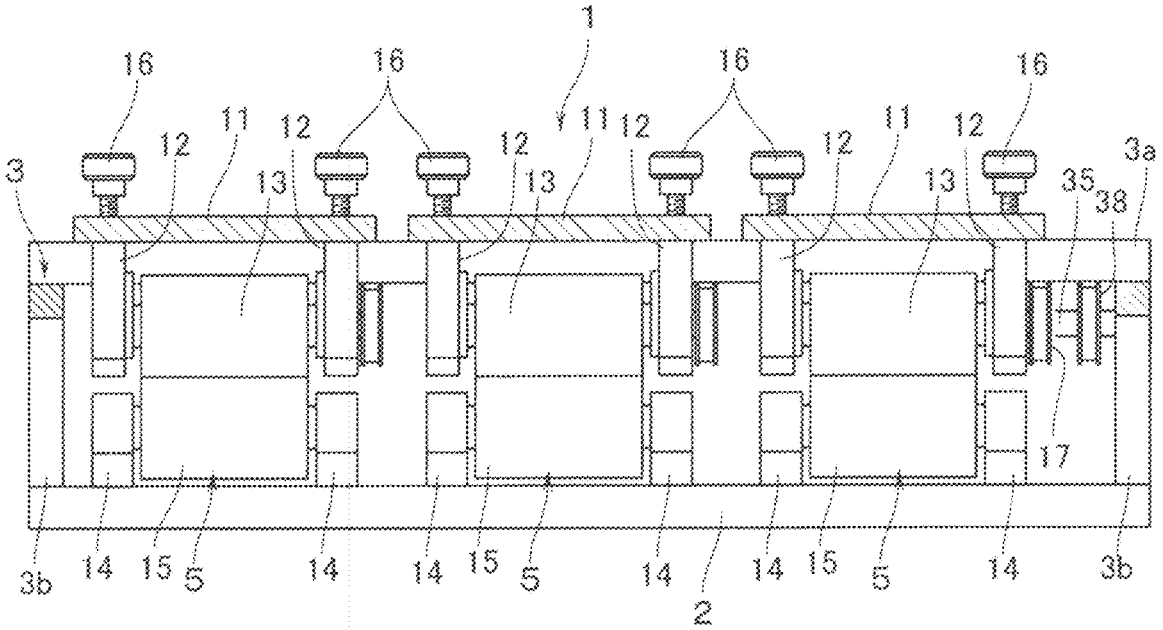
FIG. 3 is a view taken on line IV-IV in FIG. 2.
Figure 4:
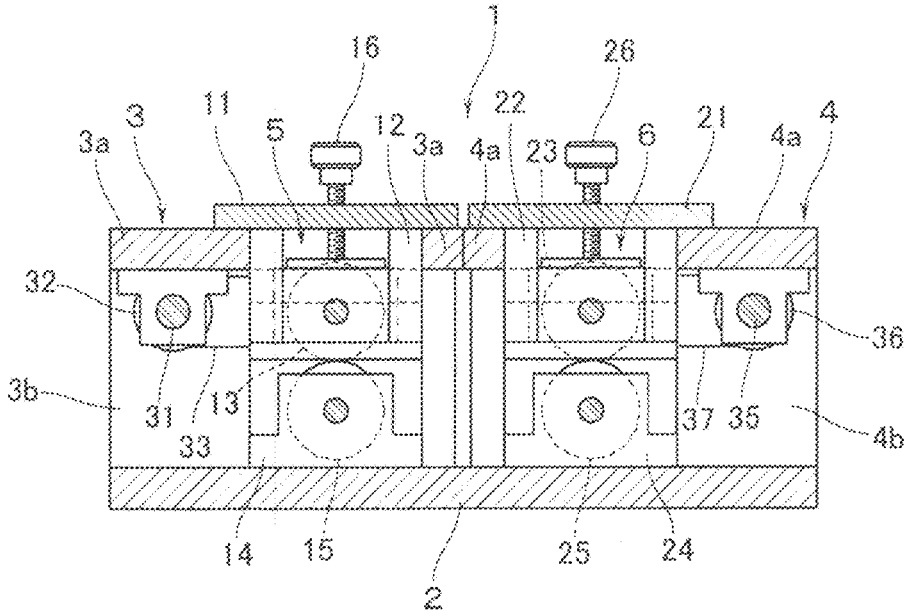
FIG. 4 is a view taken on line III-III in FIG. 2.

FIG. 1 shows the schematic status of a state in which a sheet material is being processed by the roll cutter device according to an embodiment of the present invention. FIG. 2 shows the status, in a plan view, of the roll cutter device in a state in which a top board and a ceiling frame are omitted. FIG. 3 shows the status, in a front view, of the roll cutter device (the status as viewed along arrowed line IV-IV in FIG. 2). FIG. 4 shows the status, in a side view, of the roll cutter device (the status as viewed along arrowed line III-III in FIG. 2).

As shown in the drawings, a base 2 of a roll cutter device 1 is provided with a front frame 3 of a framework and a rear frame 4 of the framework. The front frame 3 and the rear frame 4 are configured to have a pair of gate-shaped frame bodies 3*a*, 4*a* connected together by connecting frames 3*b*, 4*b*. Three roll units 5 are provided between the frame bodies 3*a* of the front frame 3. Two second roll units 6 are provided between the frame bodies 4*a* of the rear frame 4.

Two sets of the roll units 5 are provided in the axial direction of the rolls so that the central axes of the rolls are on a straight line in the axial direction. A width direction of the cutter devices is divided into a plurality of adjacent widthwise regions (X1, X2, X3, . . . ) that extend in the passing direction along the length of the roll cutter device. Two of the second roll units 6 are arranged in the width direction of a sheet material 7 at such positions that any one of the two second roll units 6 includes the space between the roll units 5 in the passing direction (indicated by an arrow in FIG. 1 and in FIG. 2) of the sheet material 7. That is, the roll units 5 and the second roll units 6 are arranged zigzag in the width direction of the sheet material 7.

The roll units 5 are provided with front top boards 11 fixed to the frame bodies 3*a* of the front frame 3. The front top board 11 is provided with a pair of upper metal frames 12, and an upper roll 13 equipped with a cutting blade is rotatably supported between the upper metal frames 12. On the base 2 is provided a pair of lower metal frames 14 opposite to the upper metal frames 12, and a receiving roll 15 is rotatably supported between the lower metal frames 14.

The roll unit 5 has the upper roll 13 and the receiving roll 15 constituting a pair of rolls. The central axes of the upper rolls 13 and the receiving rolls 15 of the three roll units 5 are arranged to be on straight lines, respectively, in the axial direction.

The upper roll 13 is supported by the upper metal frames 12 to be ascendable and descendable, and the upper and lower positions of the upper roll 13 with respect to the upper metal frames 12 are adjusted by front adjustment screw members 16. In other words, the interaxial distance between the upper roll 13 and the receiving roll 15 (interaxial distance of the pair of rolls) is adjusted by the front adjustment screw members 16 (adjustment means).

The second roll units 6 are provided with rear top boards 21 fixed to the frame bodies 4*a* of the rear frame 4. The rear top board 21 is provided with a pair of upper metal frames 22, and an upper roll 23 equipped with a cutting blade is rotatably supported between the upper metal frames 22. On the base 2 is provided a pair of lower metal frames 24 opposite the upper metal frames 22, and a receiving roll 25 is rotatably supported between the lower metal frames 24.

The second roll unit 6 has the upper roll 23 and the receiving roll 25 constituting a pair of rolls. The central axes of the upper rolls 23 and the receiving rolls 25 of the two second roll units 6 are arranged to be on straight lines, respectively, in the axial direction.

The upper roll 23 is supported by the upper metal frames 22 to be ascendable and descendable, and the upper and lower positions of the upper roll 23 with respect to the upper metal frames 22 are adjusted by rear adjustment screw members 26. In other words, the interaxial distance between the upper roll 23 and the receiving roll 25 (interaxial distance of the pair of rolls) is adjusted by the rear adjustment screw members 26 (adjustment means).

As the adjustment means, it is possible to apply not only the adjustment screw members, but also other mechanisms, for example, mechanisms for elevating and lowering the upper roll 13 (23) by putting in and taking out wedge members, as long as they are mechanisms for adjusting the upper and lower positions of the upper roll 13 (23) relative to the upper metal frames 12 (22).

As shown mainly in FIG. 1, upper gears 17 are provided at the ends of the upper rolls 13 of the three roll units 5, and a front transmission shaft 31 is rotatably supported by the front frame 3. Opposite the upper gears 17, front transmission gears 32 are provided at the front transmission shaft 31. A front belt 33 is looped between the upper gear 17 and the front transmission gear 32. That is, the front transmission shaft 31 is rotated, whereby the three upper rolls 13 are synchronously rotated via the front transmission gears 32, the front belts 33, and the upper gears 17.

Upper gears 27 are provided at the ends of the upper rolls 23 of the two second roll units 6, and a rear transmission shaft 3*b* is rotatably supported by the rear frame 4. Rear transmission gears 36 are provided at the rear transmission shaft 35 opposite the upper gears 27, and a rear belt 37 is looped between the upper gear 27 and the rear transmission gear 36. That is, the rear transmission shaft 35 is rotated, whereby the two upper rolls 23 are synchronously rotated via the rear transmission gears 36, the rear belts 37, and the upper gears 27.

A front shaft gear 34 is provided at the end of the front transmission shaft 31, while a rear shaft gear 38 is provided at the end of the rear transmission shaft 35. An interlocking belt 35 is stretched between the front shaft gear 34 and the rear shaft gear 38, and the front transmission shaft 31 and the rear transmission shaft 35 are rotated in synchronism via the interlocking belt 39. That is, the upper rolls 13 of the three roll units 5 and the upper roils 23 of the two second roll units 6 are rotated in synchronization.

In the above-described roll cutter device 1, the sheet material 7 is passed between the upper roll 13 and the receiving roll 15 of the roll unit 5 and between the upper roll 23 and the receiving roll 25 of the second roll unit 6. For example, the take-up driving of the sheet material 7 corotates the upper rolls 13, 23 and the receiving rolls 15, 25 accordingly. Since the upper rolls 13, 23 and the receiving rolls 15, 25 are corotated as above, the upper rolls 13 of the three roll units 5 and the upper rolls 23 of the two second roll units 6 are rotated in synchronization, whereby all the rolls are simultaneously rotated in an interlocked manner.

Since all the rolls are simultaneously rotated in an interlocked manner, blanking is performed, with 5 types of cutting blades being provided in the width direction of the sheet material 7. That is, blanking can be carried out for the wide sheet material 7 which can be subjected to 5 types of blanking operations in the width direction.

Figure 5:
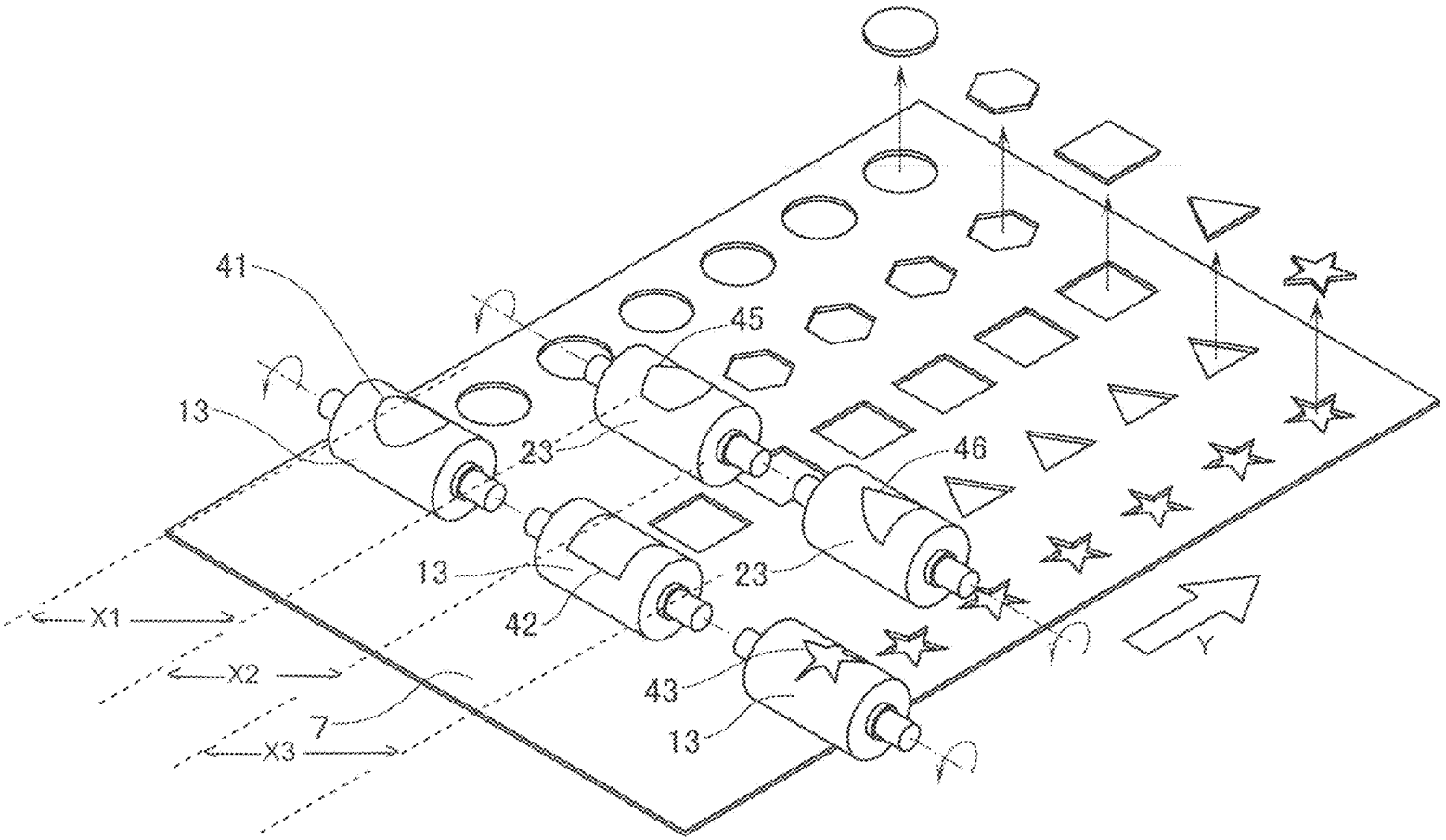
FIG. 5 is a schematic view illustrating an example of processing.

A shown in FIG. 5, for example, the upper roll 13 of the roll units 5 are formed with a round cutting blade 41 of a round shape, a square cutting blade 42 of a square shape, and a star cutting blade 43 of a star shape, respectively. On the other hand, the upper rolls 23 of the second roll units 6 are formed with a hexagon cutting blade 45 of a hexagonal shape, and a triangle cutting blade 46 of a triangular shape, respectively. By passing the sheet material 7 through the roll units 5 and the second roll units 6, round, square, star, hexagonal, and triangular blanked materials are obtained from the sheet material 7.

The rolls of the roll units 5 and the second roll units 6 are independent of each other, so that they can be made lightweight and they do not undergo a great push pressure. Even if the sheet material 7 is extremely thin, therefore, a pulling force for causing corotation does not become too high, and the upper rolls 13, 23 as well as the receiving rolls 15, 25 can be corotated without damage to the extremely thin sheet material 7.

If the single upper roll has 5 types of cutting blades, the roll must be so lengthy that the entire device will be upsized and lead to a great push pressure. In the case of an extremely thin sheet material 7, therefore, its strength does not withstand the tensile force for causing corotation, and the sheet material 7 may be damaged. With the above-described roll cutter device 1, the rolls are free from a great push pressure. Thus, the upper rolls 13, 23 and the receiving rolls 15, 25 can be corotated without, damage to the extremely thin sheet material 7. Consequently, the roll cutter device can achieve blanking of a plurality of types (e.g., 5 types) of shapes without the need to use a mechanism for driving the rolls.

Assume, for example, that 5 types of cutting blades are formed in the single upper roll. It is conceivable here, for example, that the round cutting blade 41, square cutting blade 42, star cutting blade 43, hexagon cutting blade 45, and triangle cutting blade 46 in FIG. 5 are formed in the single roll. In this case, if one of the cutting blades (for example, the round cutting blade 41 in FIG. 5) is damaged, the upper roll needs to be replaced, even when any of the cutting blades (for example, the square cutting blade 42, star cutting blade 43, hexagon cutting blade 45, or triangle cutting blade 46 in FIG. 5) remains undamaged. With the aforementioned roll cutter device 1, if one of the cutting blades is damaged, it is sufficient to replace only the faulty upper roll.

By using the above-mentioned roll cutter device 1, blanking can be performed on the sheet material 7 by means of five types of cutting blades (for example, the round cutting blade 41, square cutting blade 42, star cutting blade 43, hexagon cutting blade 45, and triangle cutting blade 46 in FIG. 5), and the five types of blanking operations can be carried out in the width direction of the sheet material 7.

Hence, it becomes possible to apply blanking to the sheet material 7 with a large width (thin plate material), without using an extensive device.

The foregoing embodiment illustrates the roll cutter device 1 employing a combination of the upper roll 13 or 23 (cutter roll) formed with the cutting blade, and the receiving roll 15 or 25 as a pair of rolls for performing blanking. However, the roll cutter device can be configured to be one employing a pair of roll cutters formed with cutting blades as a pair of rolls for boring fine holes at points where the cutting blades intersect. The roll cutter device in this case can handle a work with a thickness of the order of 0.005 mm to 0.1 mm as the thin plate material.

The above embodiment, moreover, describes the roll cutter device as a device equipped with the three roll units 5 and the two second roll units 6. However, the roll cutter device can be equipped with two of the roll units 5 and one of the second roll units 6. Besides, the roll cutter device can be equipped with four or more of the roll units 5 and three or more of the second roll units 6.

Furthermore, the configuration in which the upper rolls 13, 23 and the receiving roils 15, 25 are corotated by take-up driving of the sheet material 7 has been taken as an example for illustration. However, it is acceptable to adopt a configuration in which the upper rolls 13, 23 (receiving roils 15, 25) are driven. In this case, the plurality of upper rolls 13, 23 can be driven in unison by connecting a motor or the like to the front transmission shaft 31 or the rear transmission shaft 35 shown in FIG. 2.

INDUSTRIAL APPLICABILITY

The present invention can be utilized in the industrial field of a roll cutter device for taking a blanked material out of a thin plate material, or for boring a thin plate-shaped sheet.

EXPLANATIONS OF LETTERS OR NUMERALS

1 Roll cutter device
2 Base
3 Front frame
4 Rear frame
5 Roll unit
6 Second roll unit
7 Sheet material
11 Front top board
12, 22 Upper metal frame
13, 23 Upper roll
14, 24 Lower metal frame
15, 25 Receiving roll
16 Front adjustment screw member
17, 27 Upper gear
21 Rear top board
26 Rear adjustment screw member
31 Front transmission shaft
32 Front transmission gear
33 Front belt

34 Front shaft gear
35 Rear transmission shaft.
36 Rear transmission gear
37 Rear belt
38 Rear shaft gear

The invention claimed is:

1. A roll cutter device comprising:

plural first roll units and plural second roll units, the plural first roll units being spaced apart from each other in a width direction of the cutter device and the plural second roll units being spaced apart from each other in the width direction of the cutter device, each first roll unit composed of a pair of first rolls on a pair of independent first shafts, namely, a first upper roll on a first upper shaft, and a first lower roll on a first lower shaft, the first upper roll being a first cutting roll equipped with a first blade, and the first lower roll being a first receiving roll, the first upper shafts extending in a same first upper axial direction in the width direction of the cutter device with the first upper shafts being spaced apart from each other in the first upper axial direction, the first lower shafts extending in a same first lower axial direction in the width direction of the cutter device with the first lower shafts being spaced apart from each other in the first lower axial direction, each first upper roll extending in the same first upper axial direction of the first upper shafts and each first lower roll extending in the same first lower axial direction of the first lower shafts, each second roll unit composed of a pair of second rolls on a pair of independent second shafts, namely, a second upper roll on a second upper shaft, and a second lower roll on a second lower shaft, the second upper roll being a second cutting roll equipped with a second blade, and the second lower roll being a second receiving roll, the second upper shafts extending in a same second upper axial direction in the width direction of the cutter device with the second upper shafts being spaced apart from each other in the upper axial direction, the second lower shafts extending in a same second lower axial direction in the width direction of the cutter device with the second upper shafts being spaced apart from each other in the lower axial direction, each second upper roll extending in the same second upper axial direction of the second upper shafts and each second lower roll extending in the same second lower axial direction of the second lower shafts; and adjustment means for adjusting a first interaxial distance between the pair of first rolls of each of the first roll units and a second interaxial distance between the pair of second rolls of each of the second roll units, wherein a thin plate material is passable, in a passing direction along a length of the roll cutter device, between the pair of first rolls of each of the first roll units and between the pair of second rolls of each of the second roll units, wherein a width of the cutter device is divided into a plurality of adjacent non-overlapping widthwise regions that extend lengthwise along the length of the roll cutter device in the passing direction of the thin plate material, wherein the first upper rolls and the first lower rolls of a set of three of the first roll units are arranged on same axis lines respectively in the first upper axial direction and the first lower axial direction, wherein the second upper rolls and the second lower rolls of a set of two of the second roll units are arranged on the same axis lines respectively in the second upper axial direction and the second lower axial direction, and wherein each of the first rolls of the set of three of the first roll units and each of the second rolls of the set of two of the second roll units are disposed at offset positions in a respective different one of the widthwise regions along the width of the cutter device so that the adjacent widthwise regions of the first rolls of the set of three of the first roll units and of the second rolls of the set of two of the second roll units are non-overlapping in the passing direction of the thin plate material along the length of the roll cutter device, a first one of the set of three of the first roll units extending only over a first of the adjacent widthwise regions, a first one of the set of two of the second roll units extending only over a second of the adjacent widthwise regions, and a second one of the set of three of the first roll units extending only over a third of the adjacent widthwise regions, the first and second adjacent widthwise regions being immediately adjacent each other and non-overlapping each other, and the second and third adjacent widthwise regions being immediately adjacent each other and non-overlapping each other.

2. The roll cutter device of claim 1, wherein each of the first and second roll units is provided with a respective one of the adjustment means such that the interaxial distance between each of the first and second rolls is individually adjustable by the respective one of the adjustment means.

3. The roll cutter device of claim 1, wherein the first roll units and the second roll units are arranged in a zigzag pattern in the width direction of the roll cutter device with the set of the three of the first roll units being located upstream, in the passing direction, of the set of the two of the second roll units.

4. The roll cutter device of claim 1, wherein the set of the three of the first roll units is located upstream, in the passing direction, of the set of the two of the second roll units.

5. The roll cutter device of claim 3, wherein each of the first and second roll units is provided with a respective one of the adjustment means such that the interaxial distance between each of the first and second rolls is individually adjustable by the respective one of the adjustment means.

* * * * *